US011103087B2

(12) United States Patent
Lewis et al.

(10) Patent No.: US 11,103,087 B2
(45) Date of Patent: Aug. 31, 2021

(54) UPHOLSTERED FURNITURE WITH INTEGRATED BACK REST PORTION WEBBING SUPPORT

(71) Applicant: Ashley Furniture Industries, LLC, Arcadia, WI (US)

(72) Inventors: James Allen Lewis, Pontotoc, MS (US); Philip Lee Stokes, Ecru, MS (US); James Anthony Sudduth, Thaxton, MS (US); Jimmy Dale Holley, Ecru, MS (US)

(73) Assignee: Ashley Furniture Industries, LLC, Arcadia, WI (US)

( * ) Notice: Subject to any disclaimer, the term of this patent is extended or adjusted under 35 U.S.C. 154(b) by 0 days.

(21) Appl. No.: 16/877,985

(22) Filed: May 19, 2020

(65) Prior Publication Data

US 2020/0383493 A1 Dec. 10, 2020

Related U.S. Application Data

(63) Continuation of application No. 16/424,167, filed on May 28, 2019, now Pat. No. 10,653,248, which is a (Continued)

(51) Int. Cl.

*A47C 31/11* (2006.01)
*A47C 17/02* (2006.01)

(Continued)

(52) U.S. Cl.

CPC ..... *A47C 31/11* (2013.01); *A47C 17/02* (2013.01); *A47C 17/86* (2013.01); *A47C 27/001* (2013.01)

(58) Field of Classification Search

CPC ..... A47C 31/00; A47C 31/10; A47C 31/11; A47C 17/02; A47C 17/04; A47C 17/86;

(Continued)

(56) References Cited

U.S. PATENT DOCUMENTS 2,029,247 A 1/1936 Mercogliano
2,667,211 A * 1/1954 Krasnov ..... A47C 31/11 297/224

(Continued)

FOREIGN PATENT DOCUMENTS

CN 101336786 A 1/2009
TW 448732 8/2001
WO WO 2007/062321 A2 5/2007

OTHER PUBLICATIONS

Taiwan Office Action for Application No. 105133877 dated Oct. 15, 2019 and computer generated English translation (16 pages).

(Continued)

*Primary Examiner* — Mark R Wendell
(74) *Attorney, Agent, or Firm* — Christensen, Fonder, Dardi & Herbert PLLC

(57) ABSTRACT

A upholstered sofa covered by a form fitting upholstery sack where the upholstery sack incorporates a supportive material panel that has integrated support webbing into the material panel. The support webbing comprising a plurality of webbing straps. With the upholstery sack properly positioned on the back rest portion, the supportive material panel is positioned on the front of the back rest portion frame. The material panel with webbing is incorporated as a component of the upholstery sack where the upholstery sack is preformed to snugly fit over the back rest portion of a furniture frame. The back rest portion or the frame is inserted into the sack and the material panel with integrated webbing is attached to the frame. Once the material panel is positioned and fastened, the remaining components, for example, the back panels and side panels, of the upholstery sack are attached to the frame at the back rest portion. Due to the construction of the material panel with webbing, installation (Continued)

time is decreased when compared to the time required for conventional webbing and upholstery installations.

11 Claims, 10 Drawing Sheets

Related U.S. Application Data continuation of application No. 16/050,529, filed on Jul. 31, 2018, now Pat. No. 10,299,606, which is a continuation of application No. 15/299,235, filed on Oct. 20, 2016, now Pat. No. 10,034,554.

(60) Provisional application No. 62/244,052, filed on Oct. 20, 2015.

(51) Int. Cl.
*A47C 17/86* (2006.01)
*A47C 27/00* (2006.01)

(58) Field of Classification Search
CPC ..... A47C 27/00; A47C 27/001; A47C 7/22; A47C 7/24; A47C 7/26; A47C 5/02; A47C 3/00
USPC ..... 297/228.1
See application file for complete search history.

(56) References Cited

U.S. PATENT DOCUMENTS 2,800,169 A * 7/1957 Armbrecht ..... A47C 31/11 297/225
2,904,103 A * 9/1959 Nail ..... B60N 2/60 297/224
3,102,759 A * 9/1963 Stewart ..... B61F 15/02 384/276
3,246,348 A 4/1966 Osborne
3,516,096 A 6/1970 Mikos
3,695,690 A 10/1972 Carson
4,457,032 A * 7/1984 Clarke ..... B60N 2/60 297/219.1
4,563,785 A * 1/1986 Samelson ..... A47G 9/10 112/475.08
4,793,012 A * 12/1988 LaPorte ..... A45C 3/10 190/2
4,838,610 A * 6/1989 Perrin ..... A47C 31/11 297/225
5,346,278 A * 9/1994 Dehondt ..... A47D 15/006 297/219.1
5,403,066 A * 4/1995 Drum ..... B60N 2/6054 297/219.1
5,662,380 A * 9/1997 Tam ..... B62B 7/123 280/642
5,806,925 A * 9/1998 Hanley ..... A47C 31/113 297/219.1
5,809,595 A * 9/1998 Stevens ..... B60N 2/6036 297/219.1
6,338,527 B1 * 1/2002 Toyota ..... B60N 2/6054 297/229
6,428,098 B1 * 8/2002 Allbaugh ..... A47D 1/00 297/219.12
6,655,735 B1 * 12/2003 Learning ..... A47C 31/113 297/228.1
6,659,550 B2 12/2003 Hackett
6,942,298 B2 9/2005 Harrison
7,159,257 B1 * 1/2007 Struthers ..... A01K 1/035 119/28.5
7,258,399 B2 8/2007 Neustat
7,431,394 B2 * 10/2008 Neustat ..... A47C 7/72 297/219.1
7,878,588 B2 * 2/2011 Snedeker ..... A47C 31/11 297/229
8,201,290 B1 6/2012 Hooley et al.
8,393,675 B2 * 3/2013 Swanson ..... A47C 31/11 297/226
8,573,692 B2 * 11/2013 Nazginov ..... A47C 31/11 297/225
8,733,837 B2 * 5/2014 Weinstein ..... A47C 31/113 297/229
9,603,462 B2 * 3/2017 Markowitz ..... B60N 2/60
2002/0194676 A1 12/2002 Yang
2003/0192124 A1 * 10/2003 Setzer ..... F16F 3/10 5/655.7
2004/0013853 A1 * 1/2004 Mandzsu ..... B32B 3/14 428/143
2004/0066068 A1 4/2004 Nazginov
2005/0017553 A1 * 1/2005 Duncan ..... A47C 7/54 297/218.1
2005/0225134 A1 10/2005 Tseng
2006/0012228 A1 1/2006 Bardouche
2006/0175883 A1 * 8/2006 Neustat ..... A47C 31/11 297/229
2006/0249998 A1 11/2006 Westendorf et al.
2007/0001503 A1 * 1/2007 Brady ..... A47B 95/043 297/423.4
2007/0114823 A1 5/2007 Miller
2007/0262624 A1 * 11/2007 Snedeker ..... B60N 2/28 297/219.1
2008/0179926 A1 * 7/2008 Kushner ..... A47C 31/11 297/220
2008/0309145 A1 12/2008 Brandtner
2008/0315641 A1 12/2008 Miller
2008/0315642 A1 12/2008 Miller
2009/0193616 A1 * 8/2009 Hendricks ..... A47B 97/00 16/30
2010/0314915 A1 * 12/2010 Mills ..... B62B 9/142 297/188.01
2011/0039053 A1 * 2/2011 Lin ..... A61F 13/49011 428/85
2011/0192419 A1 * 8/2011 Davis ..... B32B 25/045 134/6
2011/0298340 A1 * 12/2011 Nelson ..... A47C 7/002 312/111
2012/0186016 A1 * 7/2012 Martin ..... A47G 9/0253 5/490
2012/0212021 A1 * 8/2012 Hunter ..... A47C 4/028 297/232
2014/0049091 A1 * 2/2014 Gross ..... A47C 7/22 297/452.63
2014/0091609 A1 * 4/2014 Van Der Jagt ..... F16F 1/26 297/411.2
2014/0265483 A1 9/2014 Miller
2014/0375103 A1 * 12/2014 Lejcher ..... A47C 7/22 297/440.1
2016/0174715 A1 * 6/2016 Nelson ..... A47C 15/002 297/440.14
2017/0156509 A1 * 6/2017 Markowitz ..... A47C 31/113
2017/0196370 A1 * 7/2017 Markowitz ..... A47C 31/11
2019/0014918 A1 * 1/2019 Markowitz ..... B32B 5/245

OTHER PUBLICATIONS

Notification of Transmittal of the International Search Report and the Written Opinion of the International Searching Authority, or the Declaration for Application PCT/US2016/057959, dated Feb. 21, 2017 (3 pages).
China Second Office Action for Application No. 201680069081.8 dated Mar. 3, 2021 and computer generated English translation (13 pages).

* cited by examiner

UPHOLSTERED FURNITURE WITH INTEGRATED BACK REST PORTION WEBBING SUPPORT

This application is a continuation of U.S. application Ser. No. 16/424,167, filed May 28, 2019, now U.S. Pat. No. 10,653,248, which is a continuation of U.S. application Ser. No. 16/050,529, filed Jul. 31, 2018, now U.S. Pat. No. 10,299,606, which claims priority to U.S. Pat. No. 10,034,554 filed on Oct. 20, 2016 and U.S. Provisional Application No. 62/244,052 filed Oct. 20, 2015. Said patents and applications are incorporated by reference herein.

FIELD OF THE DISCLOSURE

The disclosure relates to furniture construction, and in particular, to the manufacture of furniture that is upholstered. More specifically, the disclosure relates to upholstery sacks and the integration of a webbing support structure. Even more specifically, the disclosure relates to a upholstery material panel support structure where support is provided due to integrated webbing material.

BACKGROUND

In the manufacture of upholstered furniture, such as sofas, love seats, chairs, and similar items, it is desirable to manufacture and assemble the back rest portion so that the front of the back rest portion provides support to the back of the user. It is known to provide strips of webbing on the front of the back rest portion so that the webbing is attached to the top rail at one end and to the breast rail at the opposite end. While this method of manufacture provides sufficient support to the user, it is a time consuming process to install the webbing and uses an inordinate number of fasteners or staples.

Currently, the webbing is attached to a furniture frame prior to installing the upholstery sack over the furniture frame. One end of a webbing strip is attached to the top rail and the other end is attached to the breast rail using the staple and fold method. In this method, the first end of the webbing slightly overlaps the top rail and is attached to the front side of the top rail using two staples. Then, the overlapped portion of the webbing is brought down over the stapled webbing and is subsequently attached, using three staples, over the already stapled portion of the webbing resulting in the use of five staples to hold the end of the webbing to the top rail. The installer pulls the second end of the webbing to the front of the breast rail and pulls it taut. While holding the webbing under proper tension, the same staple and fold process is followed on the breast rail for the second end of the webbing, also resulting in the installation of five staples for the webbing end. In general, sofas can have nine webbings, with each webbing requiring at least ten staples, requiring a total of 90 staples on a standard back rest portion. After the webbing is attached, the upholstery sack is then positioned over the back rest portion and stapled into place using at least 80 or more staples thus completing the assembly of the back rest portion.

The above process of manufacturing the upholstered back rest is time consuming and costly since a number of parts must be assembled to construct the back rest and a large number of fasteners must be placed while correctly positioning and tensioning the webbing and then the upholstery sack. As such, there is a need for a simplified method for manufacturing upholstered furniture back rest portions that reduces labor and material costs while providing a product that provides a sufficient or improved level of support and comfort to the user.

SUMMARY

The disclosure addresses the need in the furniture manufacturing industry for a cost-effective and efficient way of providing furniture items having upholstered back rests that provide support at the front of the back rest and an expected and sufficient level of comfort to the user while also providing a structurally sound and sturdy product.

Disclosed is a piece of upholstered furniture covered by a form fitting upholstery sack where the upholstery sack incorporates a supportive material panel that integrates support webbing into the material panel. With the upholstery sack properly positioned on the back rest portion, the supportive material panel is positioned on the front of the back rest frame. The material panel with webbing is incorporated as a component of the upholstery sack where the upholstery sack is pre-formed to snugly fit over the back rest portion of a furniture frame. The back rest frame is inserted into the sack and the material panel with integrated webbing is attached to the frame. Once the material panel is positioned and fastened, the remaining components, for example, the back panels and side panels, of the upholstery sack are attached to the back rest frame. Due to the construction of the material panel with webbing, installation time is decreased when compared to the time required for conventional webbing and upholstery installations. In addition, there is a decrease in the number of fasteners used to attach the upholstery sack and webbing when compared to the conventional installation methods.

The disclosed assembly and method entail attaching webbing to the top end and to the bottom end of the material that will cover the front and top portions of the furniture frame back rest portion. This material is attached to the back panel and side panels that together form the upholstery sack. The assembled upholstery sack is positioned onto the back rest portion of the sofa frame, and due to its integrated construction, the webbing is positioned concurrent with the material panel. The webbing is then attached, with up to three fasteners per webbing end, to the back of the top rail of the back rest portion. In doing so, the fasteners that hold the webbing also hold the material to the frame since the webbing and material are attached. Attaching to the rear of the top rail and pulling the material and webbing over the top of the top rail adds strength to the holding power of the fasteners. This process saves time and fasteners due to the incorporation of two different assembly processes being combined into one. If needed, more fasteners can be added in the spaces between the strips of webbing to hold the material.

The assembly of the back rest portion continues with the webbing and material being pulled as one unit under the breast rail. The webbing and material is pulled taut to provide tension on the webbing. The webbing and material are then fastened to the top of the spring rail or, alternatively, to the back of the breast rail. Pulling the material and webbing under the breast rail adds strength to the holding power of the fasteners. The finished front of the back portion has tight webbing and tight material accomplished with a lower fastener count and less installation time than the conventional method of webbing installation. In some embodiments, fasteners counts were reduced by as much as 50%. Finishing the installation of the upholstery sack is done by fastening the side panels to the back rest portion and the back material panel to the back rest portion and back of the seat base.

In another embodiment, it may be desired that the material and attached webbing be attached to the back portion frame prior to incorporating the material and webbing into the upholstery sack. This would entail attaching the material and attached webbing to the frame as disclosed above and then attaching the remaining pieces of the upholstery sack as individual components.

There are numerous configurations of and numerous types of materials that can be used as part of the assembly of the upholstery sack and/or material panel. This disclosure contemplates that various configurations can be provided and that the configurations disclosed within are not limiting.

In one embodiment, an upholstered sofa comprising a frame having a rectangular seat base with an integral spring rail, an upright back rest portion integral with the seat base, and a right arm rest and a left arm rest integral with the seat base and back rest portion. The seat base and back rest are disposed between the right arm rest and the left arm rest. The seat base has a rectangular shape and forms a box frame having a left side, a right side, a front side, and a back side defining an open interior space. The back rest portion is affixed to the back side of the seat base so that the back rest portion is in an upright position and the back rest portion further comprises a back side, a back side outwardly facing surface, a bottom side, a top rail, and a breast rail.

The upholstered sofa further comprises an upholstery sack having a back material panel, a left side material panel, a right side material panel, and an integrated upholstery support assembly. The upholstery support assembly is further comprised of a back cushion facing material portion having a top end and a bottom end and a plurality of spaced webbings, each having a length, a first end, a middle portion, and a second end wherein each webbing first end is fixedly attached to the material portion top end and the webbing second end is fixedly attached to the material portion bottom end. The length of each webbing and a length from the material portion bottom end to the material portion top end are about equidistant. The upholstery support assembly can further comprise a second layer of finishing material over the material portion providing a cavity to receive cushioning materials. Alternatively, the upholstery support assembly can comprise a single layer of finishing material. The upholstery sack is disposed on the back rest portion and the at least one webbing is disposed adjacent a top side of the top rail. The at least one webbing first end and attached material portion top end are fixedly attached to a back side of the top rail and the at least one webbing middle portion is disposed adjacent a front side of the breast rail. The at least one webbing and material portion proximate the at least one webbing second end is fixedly attached to a top side of the spring rail. The left side material panel and right side material panel are fixedly attached to the back rest portion. The back material panel is fixedly attached to the back rest portion and seat base back side. Attachment of the upholstery sack is made with the use of fasteners where the fasteners can be staples, nails, tacks, brads, or any method known to those with skill in the furniture assembly art.

In embodiments, the material portion comprises a plurality of material panels, wherein each material panel is attached on at least one edge to an edge of a different material panel. In embodiments, the material portion comprises a single layer of material. In embodiments, the material portion comprises a multi-layer configuration of materials. In embodiments, the at least one webbing and material portion proximate the at least one webbing second end can be fixedly attached to a back side of the breast rail.

In one embodiment, an upholstery support assembly can have a material portion having a top end and a bottom end. The upholstery support assembly can have at least one webbing having a length, a first end, a middle portion, and a second end. The webbing first end can be fixedly attached to the material portion top end and the webbing second end can be fixedly attached to the material portion bottom end. The length of the at least one webbing and a length from the material portion bottom end to the material portion top end are about equidistant. The webbing can be disposed adjacent a top side of a top rail of a furniture frame. The webbing first end and attached material portion top end can be fixedly attached to a back side of the top rail of the furniture frame. The webbing middle portion can be disposed adjacent a front side of a breast rail of the furniture frame, and the webbing and material portion proximate the webbing second end can be fixedly attached to a top side of a spring rail or a back side of the breast rail of the furniture frame.

In another embodiment, an upholstery support assembly can have a material portion having a top end and a bottom end. The material portion can have a first material panel having a top end and a bottom end and a second material panel having a first end and a second end such that the second material panel first end is fixedly attached to the first material panel top end. The webbing can have a length, a first end, a middle portion, and a second end. The webbing first end can be fixedly attached to the material portion top end and the at least one webbing second end can be fixedly attached to the material portion bottom end. The length of the webbing and a length from the material portion bottom end to the material portion top end are about equidistant. The webbing can be disposed adjacent a top side of a top rail of a furniture frame, and the webbing first end and attached material portion top end can be fixedly attached to a back side of the top rail of the furniture frame. The webbing middle portion can be disposed adjacent a front side of a breast rail of the furniture frame, and the webbing and material portion proximate the at least one webbing second end can be fixedly attached to a top side of a spring rail or a back side of the breast rail of the furniture frame.

In one embodiment, fasteners, for example, staples, are used to fixedly attach the webbing and the material portion to the furniture frame. In another embodiment, fasteners, for example, tacks, are used to fixedly attach the webbing and the material portion to the furniture frame.

In one embodiment, the material portion can have a plurality of material panels, such that each material panel is attached on at least one edge to an edge of a different material panel. In another embodiment, the material portion can have a single layer of material. In another embodiment, the material portion can have a multi-layer configuration of materials. In another embodiment, a cavity can be provided between two layers of the multi-layer configuration of materials, the cavity sized and configured to receive cushioning material.

In one embodiment, there is provided is a method of assembling an upholstered sofa comprising providing a frame having a rectangular seat base with an integral spring rail, an upright back rest portion integral with the seat base, and a right arm rest and a left arm rest integral with the seat base and back rest portion wherein the seat base and back rest are disposed between the right arm rest and the left arm rest. The seat base has a rectangular shape and forms a box frame having a left side, a right side, a front side, and a back side defining an open interior space. The back rest portion is affixed to the back side of the seat base so that the back rest portion is in an upright position. The back rest portion further comprises a back side, a back side outwardly facing surface, a bottom side, a top rail, and a breast rail.

The method of assembling an upholstered sofa further entails receiving an upholstery sack having a back material panel, a left side material panel, a right side material panel, and an integrated upholstery support assembly. The upholstery support assembly is further comprised of a material portion having a top end and a bottom end and at least one webbing having a length, a first end, a middle portion, and a second end. The at least one webbing first end is fixedly attached to the material portion top end and the at least one webbing second end is fixedly attached to the material portion bottom end. The length of the at least one webbing and a length from the material portion bottom end to the material portion top end are about equidistant. The upholstery sack is disposed on the back rest portion and the at least one webbing first end is disposed adjacent a top side of the top rail. The at least one webbing first end and attached material portion top end are then fixedly attached to a back side of the top rail and the at least one webbing middle portion is disposed adjacent a front side of the breast rail. The at least one webbing and material portion proximate the at least one webbing second end are fixedly attached to a top side of the spring rail. The left side material panel and right side material panel are fixedly attached to the back rest portion and the back material panel is fixedly attached to the back rest portion and seat base back side.

A feature and advantage of embodiments, is an upholstery sack that eliminates the step of separately attaching webbing before the upholstery sack.

A feature and advantage of embodiments, is an upholstery sack that includes webbing therein and that is attached at suitable locations on the upholstery sack such that attachment of the webbing also attaches fabric portions of the upholstery sack such that labor and staples are minimized.

In embodiments, assembly of the upholstered sofa can entail fixedly attaching the at least one webbing and material portion proximate the at least one webbing second end to a back side of the breast rail.

In another embodiment, there is provided is a method of assembling an upholstery support assembly. The method includes providing a material portion having a top end and a bottom end. The material portion can have a first material panel having a top end and a bottom end and a second material panel having a first end and a second end. The method can include fixedly attaching the second material panel first end to the first material panel top end and providing at least one webbing having a length, a first end, a middle portion, and a second end. The webbing first end can be fixedly attached to the material portion top end and the webbing second end can be fixedly attached to the material portion bottom end. The length of the webbing and a length from the material portion bottom end to the material portion top end are about equidistant. The method includes disposing the webbing adjacent a top side of a top rail of a furniture frame and fixedly attaching the webbing first end and attached material portion top end to a back side of the top rail of the furniture frame. The method includes disposing the webbing middle portion adjacent a front side of a breast rail of the furniture frame and fixedly attaching the webbing and material portion proximate the webbing second end to a top side of a spring rail or the back side of the breast rail of the furniture frame. In one embodiment, the method can include fixedly attaching a covering material at an end concurrently to the first material panel top end and the second material panel first end.

DETAILED DESCRIPTION

Figure 1:
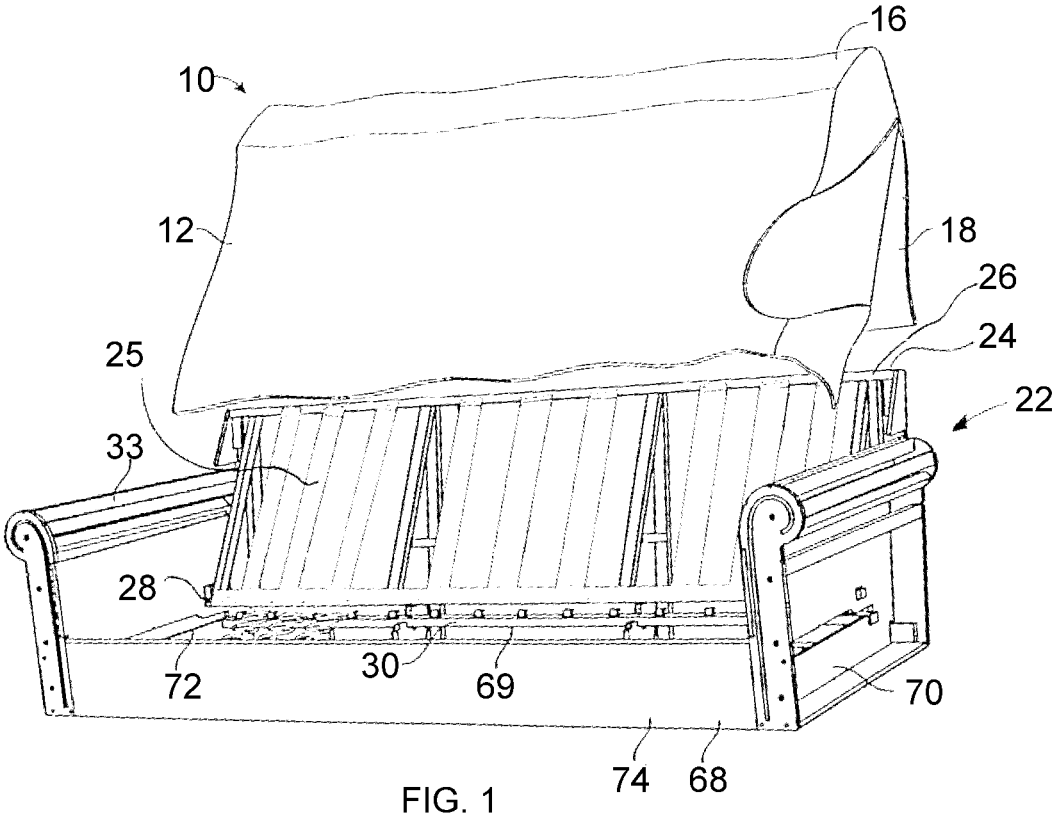
FIG. 1 PRIOR ART
FIG. 1 illustrates a prior art upholstery sack being installed on a prior art frame with preinstalled webbing.

FIG. 1 illustrates a prior art upholstery sack 10 having a first material panel 14, a top material panel 16, a back material panel 18, and side material panels 20. The upholstery sack 10 is a preassembled piece of upholstery that is a form fitting cover that corresponds to a back rest portion 24 of a furniture frame 22, see FIGS. 3 and 4, where the furniture frame 22 is the structural base for a sofa, love seat, chair, or similar item of furniture. The frame 22 of FIG. 1 has had webbing 25 pre-attached by staples on the top rail 26 and breast rail 28 prior to receiving the form fitting cover.

Figure 2:
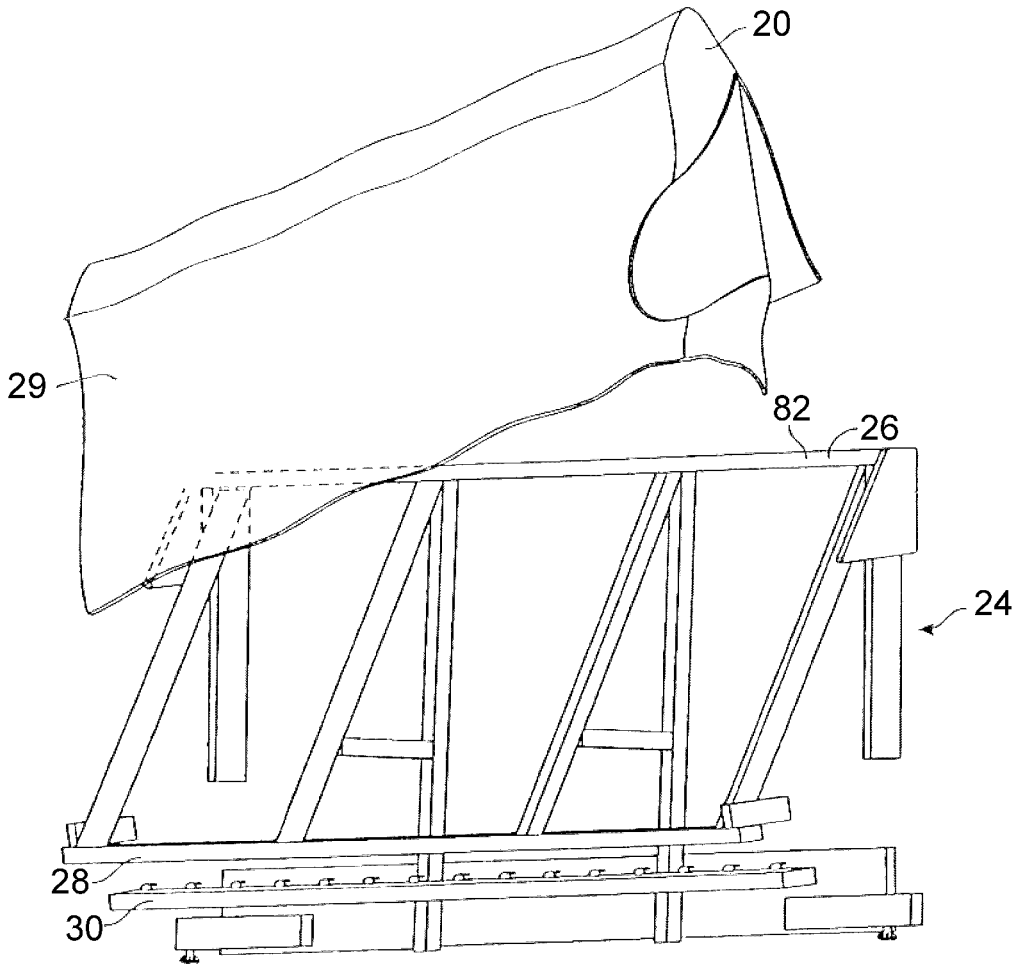
FIG. 2 is a representative view of a back rest portion of a furniture frame being inserted into an upholstery sack according to an embodiment of the disclosure.

FIG. 2 illustrates positioning of the upholstery sack 25, according to embodiments, over the back rest portion 24 so that the back rest portion 24 can be fully inserted into the upholstery sack 29 so that the upholstery sack 29 envelopes the back rest portion 24. The upholstery sack 29 is then attached to the back rest portion 22 using fasteners, such as staples, as described below the upholstery sack has upholstery frame covering portion 29.2 such as is shown in FIG. 1, and also has user support portion 29.4 comprising webbing attached to the upholstery frame covering portion.

Figure 3:
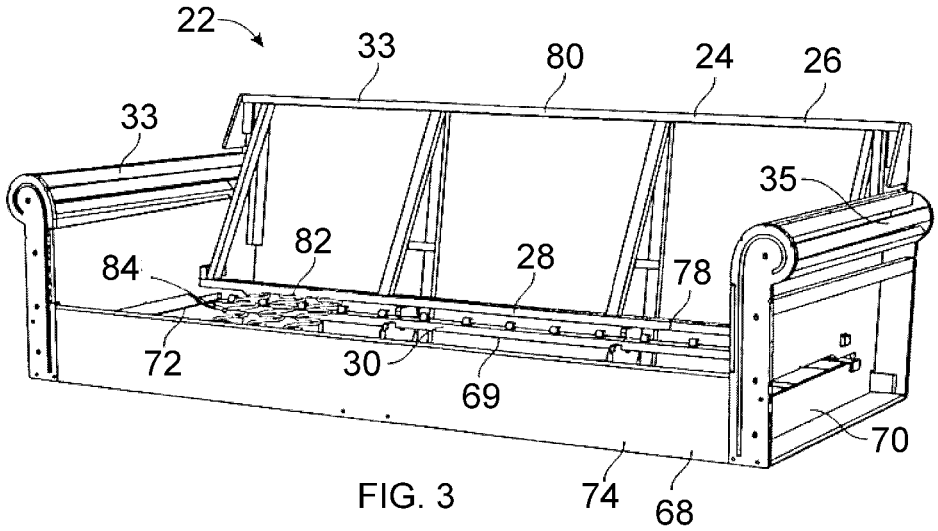
FIG. 3 is a representative front view of a furniture frame according to an embodiment of the disclosure.
Figure 4:
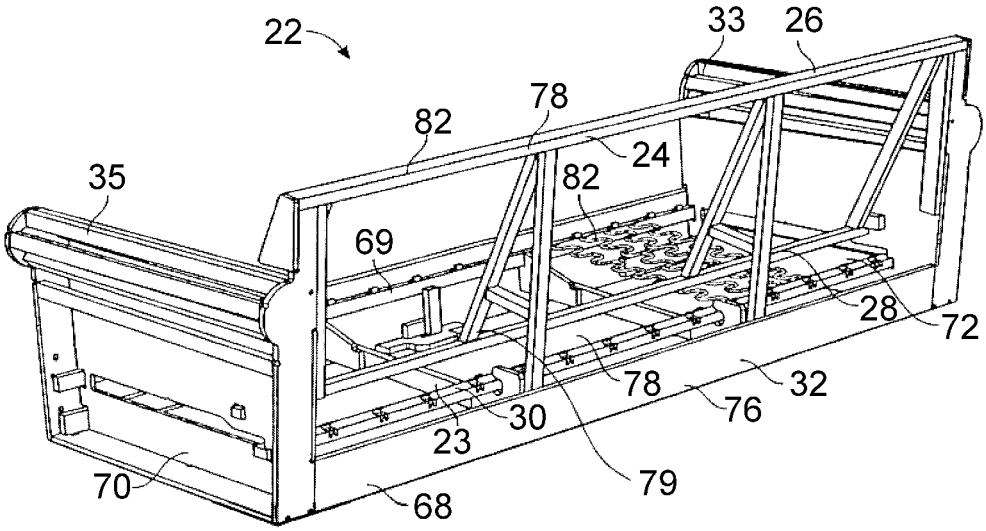
FIG. 4 is a representative back view of a furniture frame according to an embodiment of the disclosure.

This disclosure provides for a furniture frame having an attached upholstery sack 29, the upholstery sack having an integrated material panel that provides webbing support. As depicted in FIGS. 2-4, a sofa furniture frame 22, according to an embodiment of the present invention, comprises a seat base 23 and an upright back rest portion 24 integral with the seat base 23, "integral" in that components are fixed together at the factory with permanent fasteners, glue, and may have common frame members and they are not detachable from one another without damage. In embodiments, the furniture frame 22 can further comprise a pair of arm rests 33, 35 where the seat base 23 and back rest portion 24 are disposed between the arm rests 33, 35 and are integral to the arm rests 33, 35. The seat base 23 comprises a box frame 68 comprising a rectangular shape and having a left side 70, a right side 72, a front side 74, a back side 76, so that the box frame 68 defines an open interior space 69. The back rest portion 24 can further comprise a back side 78, a bottom side 80, and a top 82 with a top rail 26. The back rest portion 24 is affixed to the back side 76 of the seat base 22. The back rest portion 24 has an upright position where it is seated and secured to the seat base 22 as shown. In embodiments, a furniture frame 22 further comprises the breast rail 28 attached at a lower portion of the back rest portion and a spring rail 30. In embodiments, the furniture frame 22 can further comprise seat springs 84. In embodiments, the furniture frame 22 comprises wood or wood products. Furniture frames 22 of varying configurations are contemplated and it is apparent that frames 22 of varying configurations are within the spirit and scope of this disclosure. Attachment of an upholstery sack 29 is made to the furniture frame using fasteners, where the fasteners can be staples, nails, brads, tacks, or other types of fasteners common in the furniture assembly industry.

Figure 5A:
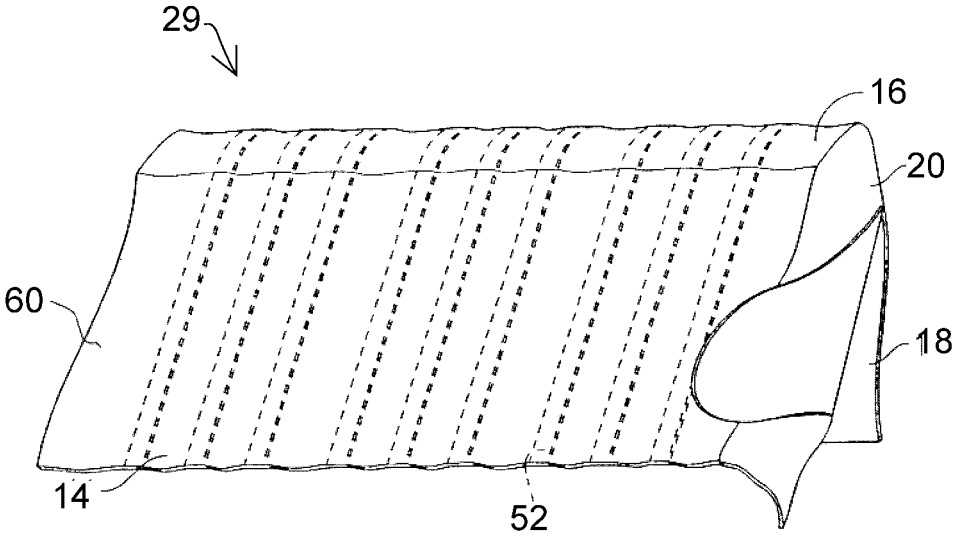
FIG. 5A is a representative front view of an upholstery sack with an integrated upholstery support assembly according to an embodiment of the disclosure.
Figure 5B:
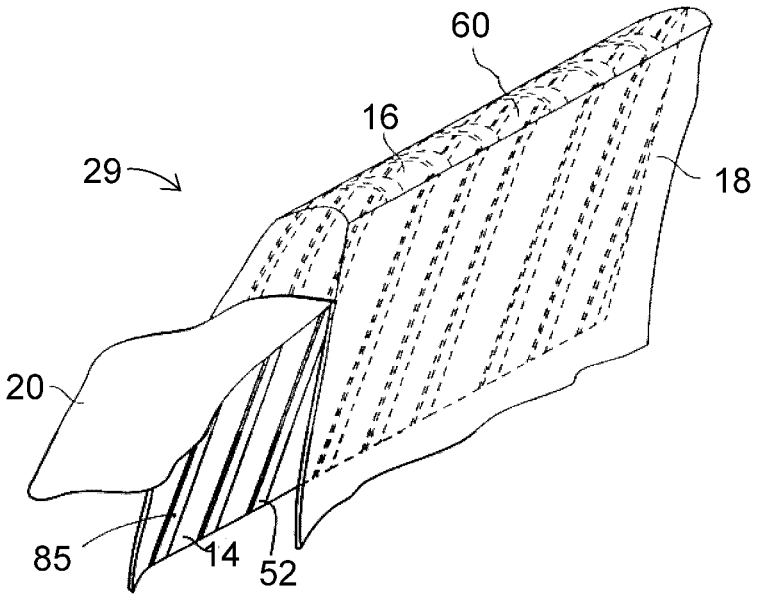
FIG. 5B is a representative back view of the upholstery sack of FIG. 5A with an integrated upholstery support assembly according to an embodiment of the disclosure.
Figure 6A:
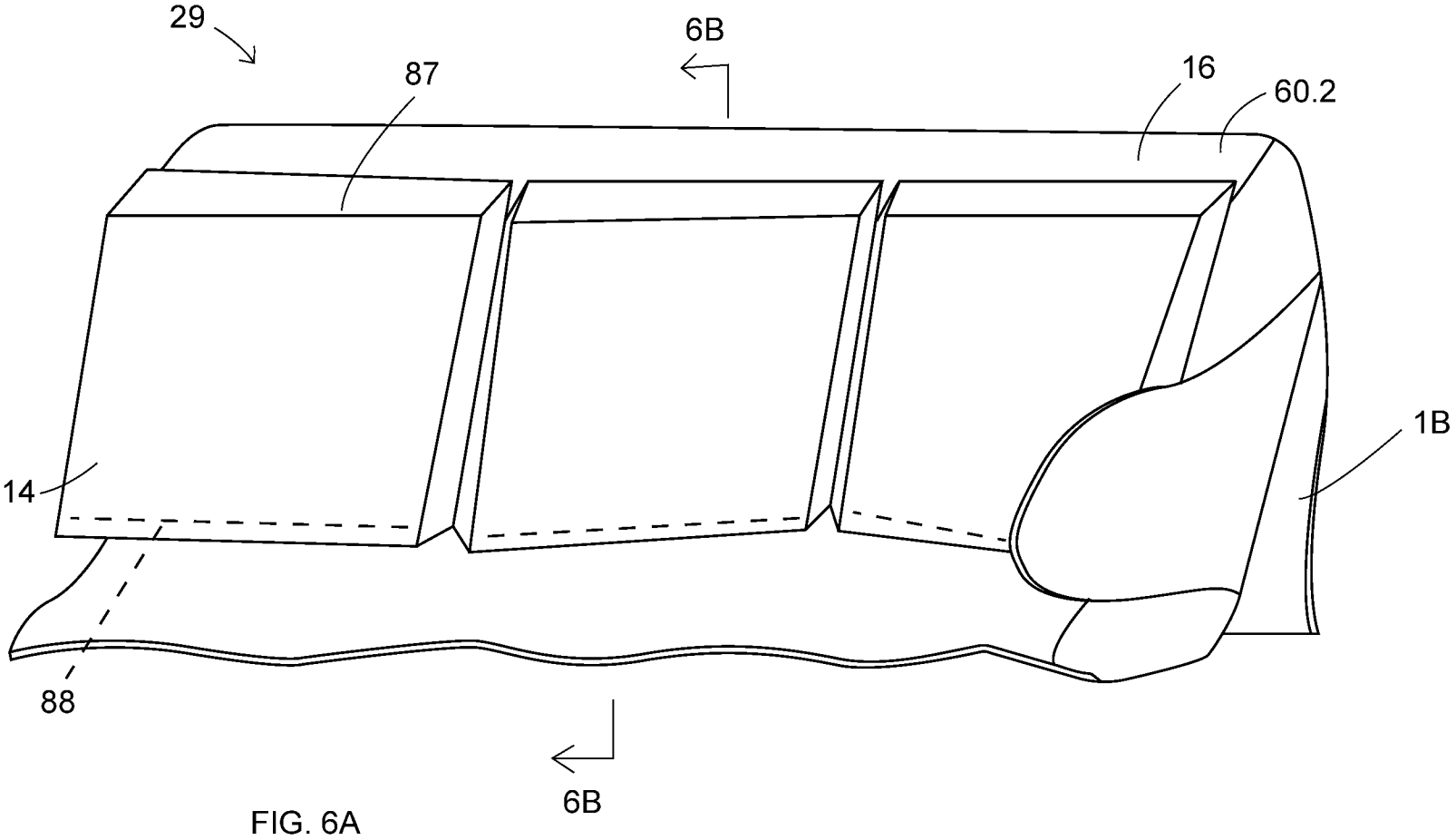
FIG. 6A is a representative front view of an upholstery sack with an integrated upholstery support assembly according to an embodiment of the disclosure.
Figure 6C:
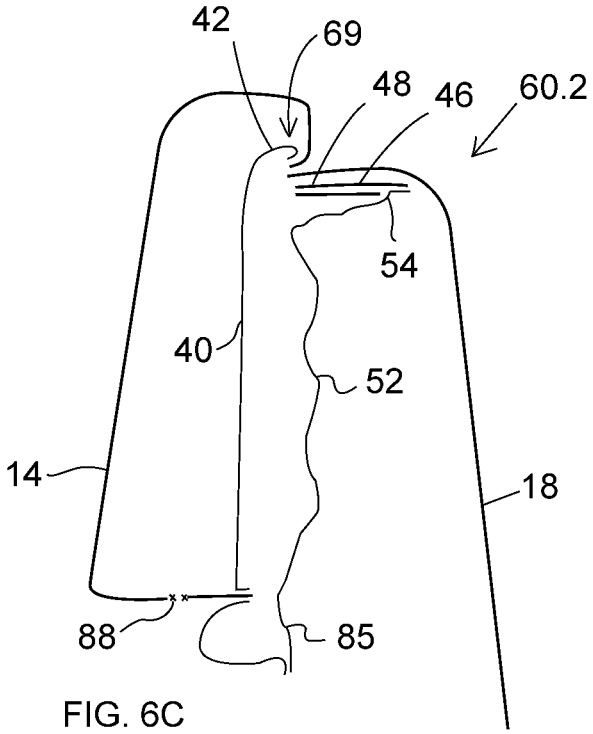
FIG. 6C is a piece part view of the upholstery sack of FIG. 6B illustrating exemplary stitch regions of the separate panels, material portions and webbing.

Referring to FIGS. 5A-6C, the upholstery sack 29 having exterior material panels 14, 16, a back material panel 18, a right side material panel 20, a left side material panel (not shown), and an integrated upholstery sack back support assembly 60, where the upholstery sack back support assembly 60 is comprised of webbing 52, as depicted in FIGS. 5 and 6. Webbing 52 is a strong fabric woven as a flat strap or tube of varying width and fibers. The webbing 52 is tightly woven, exceptionally strong and has very little to no stretch. The webbing 52 fabric can be, but is not limited to, natural jute, synthetic jute, burlap, cotton, nylon, polyester, polypropylene, and variations thereof. As described in detail below the webbing straps or strips 85 are attached to the upholstery frame covering portion at the ends of the webbing strips.

Figure 6B:
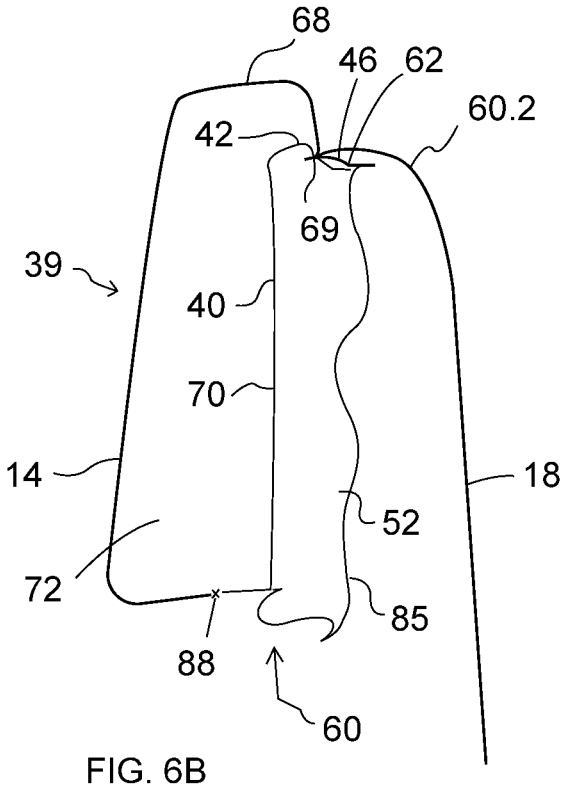
FIG. 6B is a cross section of the upholstery sack of FIG. 6A taken at line 6B-6B.

Referring to FIGS. 6A-6C, an embodiment of an upholstery sack 60.2 is illustrated having integrated seat back cushion cases 87. The interiors of such cases accessible by way of a zipper 88.

Figure 7:
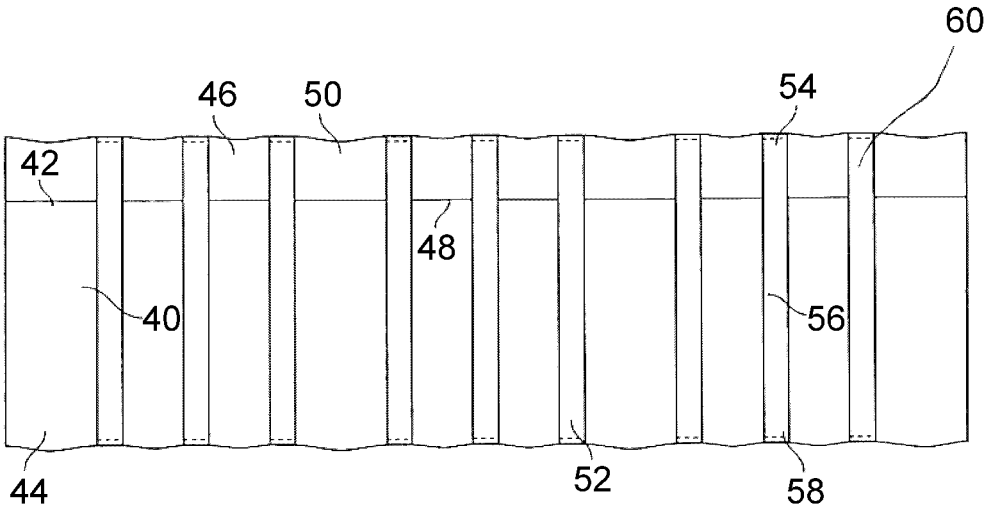
FIG. 7 is a representative view of an upholstery support assembly according to an embodiment of the disclosure.

As depicted in FIG. 7, the upholstery back support assembly 60 portion of the upholstery sack 10 includes webbing and back support material portion 39 having a top end 41 and a bottom end 43. Each seating position on the sofa may have, for example, three webbing straps. In other embodiments four webbing straps. The material portion 39, as contemplated, can be comprised of various layered configurations and materials. In one embodiment, the material portion 39 comprises a first material panel 40 having a top end 42 and a bottom end 44 and a second material panel 46 having a first end 48 and a second end 50. The first material panel 40 and the second material panel 46 can be comprised of the same or dissimilar materials, where the materials can be comprised of upholstery covering materials, finishing materials, felt or felt-like materials, polyester, lining material, cotton materials, blended materials, etc. The second material panel 46 first end 48 and the first material panel 40 top end 42 are fixedly attached to each other so that a seam holding the panels 40, 46 together is formed along the length of the material panels 40, 46. Each length of webbing 52 having a first end 54, a middle portion 56, and a second end 58. The webbing is fixedly attached, by sewing, to the material portion 39 so that the webbing 52 first end 54 is fixedly attached to the material portion 39 top end 41 and the webbing second end 58 is fixedly attached to the material portion 39 bottom end 43. It is desirable that the length of the webbing 52 and a length from the material portion 39 top end 41 to the bottom end 43 are about equidistant. In another embodiment, a plurality of lengths of webbing 52 are fixedly attached as disclosed to the material portion 39 top end 41 and material bottom end 43. When the webbing is attached to the frame, such as by staples, the material portion is also attached.

Figure 8:
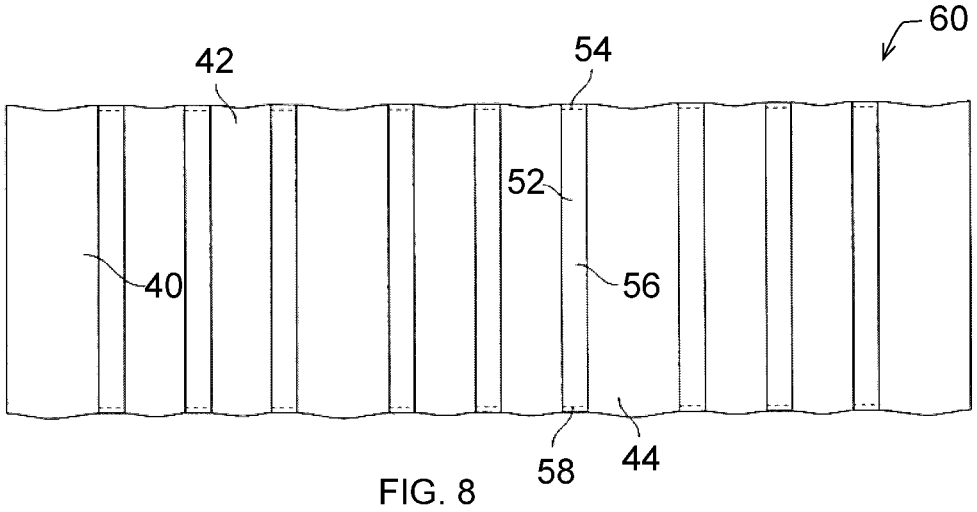
FIG. 8 is a representative view of an upholstery support assembly according to an embodiment of the disclosure.

In another embodiment, as depicted in FIG. 8, the upholstery support assembly 60 of the upholstery sack 10 is comprised of a material portion 39 having a top end 41 and a bottom end 43. The material portion 39 comprises a single piece of material. A length of webbing 52 having a first end 54, a middle portion 56, and a second end 58 is then attached, by sewing, to the material portion 39 so that the webbing 52 first end 54 is fixedly attached to the material portion 39 at the top end 41 and the webbing 52 second end 58 is fixedly attached to the material portion 39 bottom end 43. It is desirable that the length of the webbing 52 and a length from the material portion 39 top end 41 to the bottom end 43 are about equidistant. In another embodiment, a plurality of lengths of webbing 52 are fixedly attached as disclosed to the material portion 39 top end 41 and material bottom end 43.

Figure 9A:
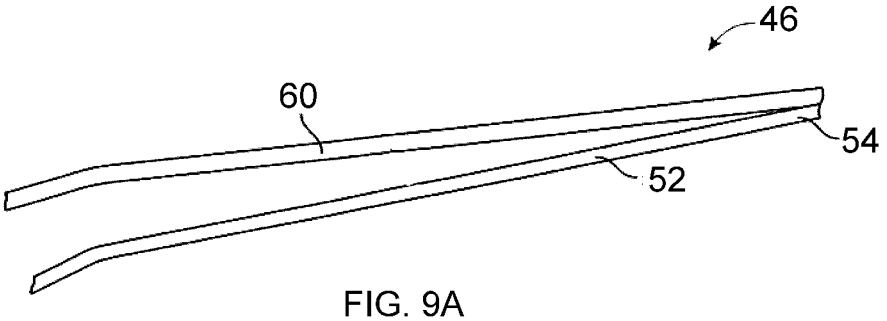
FIG. 9A is a representative cross sectional view of a portion of an upholstery support assembly according to an embodiment of the disclosure.

In one embodiment, material portion 39 is comprised of a single layer of material 60. FIG. 9A illustrates the top end 41 of the single layer of material 39 attached to the webbing 52 first end 54 and the bottom end 39 of the single layer of material 39 attached to the webbing 52 second end 58.

Figure 10B:
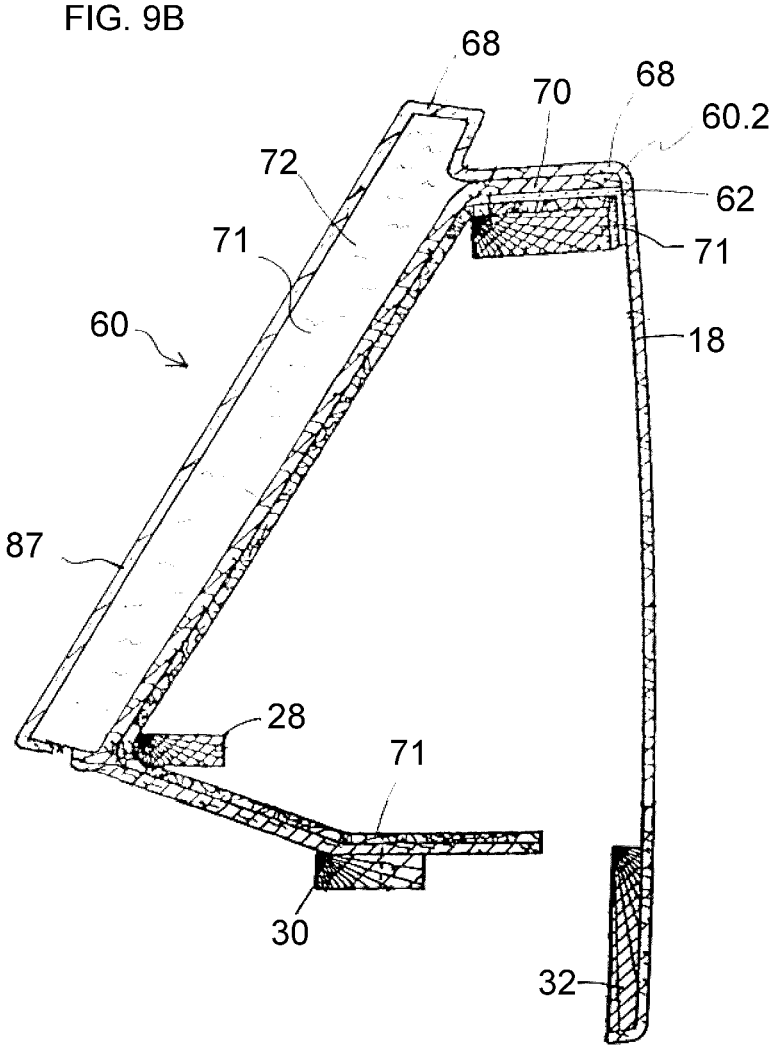
FIG. 10B is a representative cross sectional view of the upholstery sack with an integral back rest cushion attached to a sofa frame.

In an embodiment, depicted in FIGS. 6A-6C, the first material panel 40 top end 42 is fixedly attached to a first end 48 of a second material panel 46. In one embodiment, the second material panel 46 can be comprised of a felt batting 62 or similar material. The first material panel 40 top end 42 and second material panel 46 first end 48 are also attached to an end of a layer of upholstery or covering material 68 at a juncture 69 where the material edges are sewn together. The upholstery sack with said sewn-together junctures as a defining attachment region 71, where the covering material 68 comprises the upholstery sack 29 back panel 18. The second material panel 46 at a second end 50 is then fixedly attached to the webbing 52 first end 54. The first material panel 40 and second material panel 46 comprise the material portion 39. The length of the webbing 52 and a length from the material panel 40 bottom end 44 to the second material panel 46 second end 50 may be about equidistant. Such upholstery sack attached to a sofa frame is illustrated in FIG. 10B.

Figure 9B:
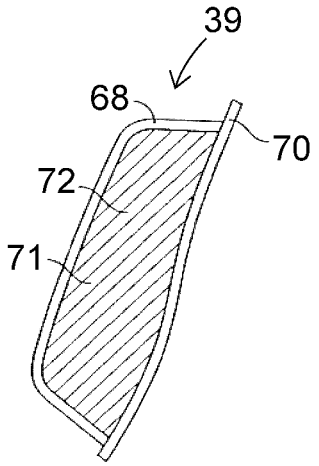
FIG. 9B is a representative cross sectional view of a portion of an upholstery support assembly according to an embodiment of the disclosure.

In another embodiment, depicted in FIG. 9B, the back support material portion 39 can be comprised of a multi-layered configuration comprised of a liner 70 and a covering material 68, wherein a cavity 71 is formed between the liner 70 and covering material 68 to receive cushioning materials 72 such that the upholstery sack 10 provides for an integrated cushion. The covering material 68 faces a user's back and is exposed. The liner covers and contacts the frame. The liner may be formed of a thin fabric.

It is contemplated that various configurations of materials and layers can be provided that comprise the back support material portion 39 and webbing 52 attachment portions and these various configurations and layers are within the spirit and scope of this disclosure.

Figure 10A:
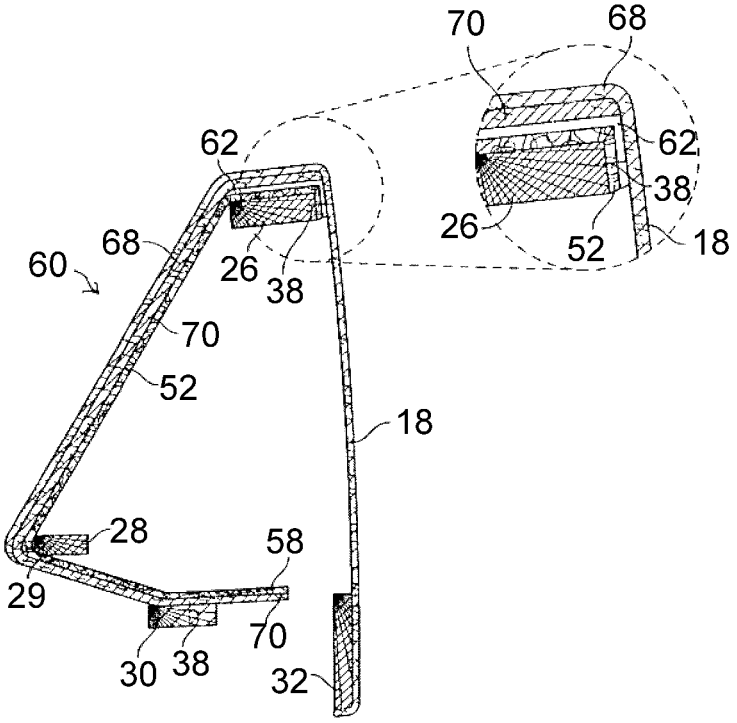
FIG. 10A is a representative cross sectional view of a back rest portion of a furniture frame having an upholstery sack with an integrated upholstery support assembly attached according to an embodiment of the disclosure.
Figure 11:
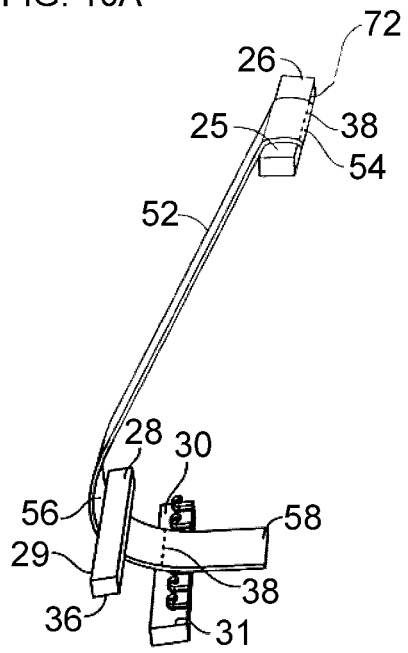
FIG. 11 is a representative view of the placement and attachment of the webbing on a back rest portion of a furniture frame according to an embodiment of the disclosure.

In one embodiment, the upholstery support assembly 60, integrated as a component of the upholstery sack 10A, is fixedly attached to the furniture frame 22 as shown in the cross sectional view in FIG. 10A. In the example embodiment shown, the upholstery support assembly 60 is comprised of the webbing 52 and the back support material portion 39, where the back support material portion 39 comprises the liner 70, the covering material 68, and the felt batting 62 or similar material. However, it is apparent that other upholstering support assemblies 12 comprised of various material layers are contemplated. The support assembly 60 is positioned on the back rest portion 24 of the furniture frame 22 so that the webbing 52 crosses over the top side 25 of the top rail 26 and the webbing 52 first end 54 contacts a back side 27 of the top rail 26, as shown in FIG. 11. The webbing 52 first end 54 and felt batting 62, which are attached, are fixedly attached to the back side 27 using a plurality of fasteners 38. It is desirable to attach the webbing 52 to the top rail 26 back side 27 due to the increased forces required for fastener 38 pull-out versus attachment of the webbing 52 to the top rail 26 top side 25 or front side 33.

The webbing 52 middle portion 56 and liner 70 are positioned so that they cross a front side 29 of the breast rail 28. The webbing 52 and liner 70 are then positioned below a bottom side 36 of the breast rail 28 and above a top side 31 of the spring rail 30. The webbing 52 second end 58 and attached liner 70 are positioned past the breast rail 30 towards the back panel 32 and pulled taut. A plurality of fasteners 38 are driven through the webbing middle portion 56 and the liner 70 into the top side 31 of the spring rail 30 to hold the webbing 52 and liner 70 taut and in position. Pulling the webbing 52 and liner 70 under the breast rail 30 adds strength to the holding power of the fasteners 38. Pulling the webbing 52 and liner 70 together and fastening as disclosed provides a tight webbing 52 and a tight liner 70, thus providing a strong back portion 24 support assembly 60. Following attachment of the integrated upholstery support assembly 60 with the back support material portion 39, the other components of the upholstery sack 10 are fixedly attached to the appropriate areas of the frame 22. The left and right side material panels 20 are fixedly attached to the back rest portion 24 and the back material panel 18 is fixedly attached to the back rest portion 24 at the sides and to the box frame 68 back side 76 at the bottom.

Referring to FIG. 10B, the discussion above with reference to FIG. 10A applies here as well. This embodiment reflects the upholstery sack of FIGS. 6A-6C, and FIG. 9B with integrated seat back cushion cases. A cavity 72 is defined for holding seat back cushion cushioning material 71 such as polyurethane foam.

Figure 12:
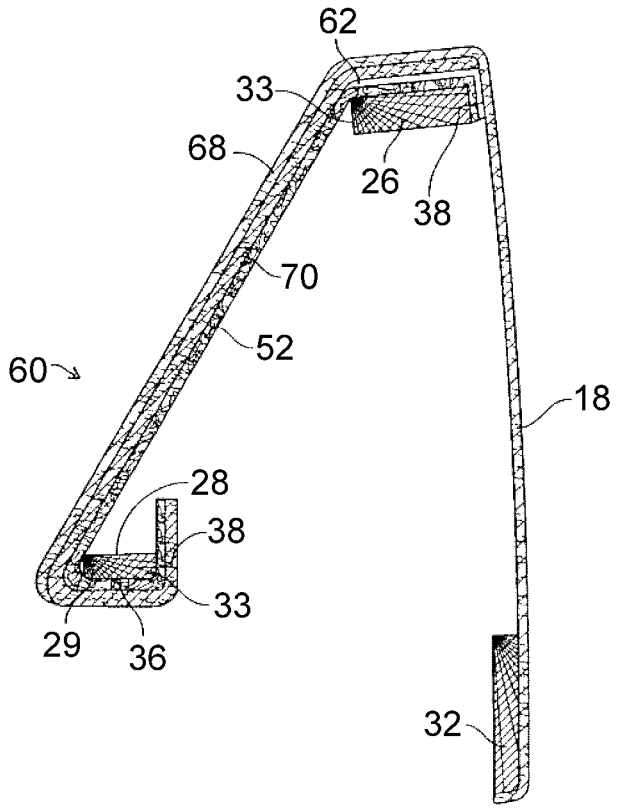
FIG. 12 is a representative cross sectional view of a back portion of a furniture frame having an upholstery sack with an integrated upholstery support assembly attached according to an embodiment of the disclosure.

In another embodiment, depicted in FIG. 12, the webbing 52 middle portion 56 and liner 70 are positioned so that they cross a front side 29 of the breast rail 28 and are then positioned to wrap below a bottom side 36 of the breast rail 28. The webbing 52 middle portion 56 and liner 70 are then positioned past a back side 33 of the breast rail and pulled taut. When the proper tension is afforded to the webbing 52 and liner 70, a plurality of fasteners 38 are driven through the webbing middle portion 56 and the liner 70 into the back side 33 of the breast rail 28 to hold the webbing 52 and liner 70 taut and in position. Pulling the webbing 52 and liner 70 under the breast rail 30 adds strength to the holding power of the fasteners 38. Pulling the webbing 52 and liner 70 together and fastening as disclosed provides a tight webbing 52 and a tight liner 70, thus providing a strong back portion 24 support assembly 60. Following attachment of the integrated upholstery support assembly 60, the other components of the upholstery sack 10 are fixedly attached to the appropriate areas of the frame 22. The left and right side material panels 20 are fixedly attached to the back rest portion 24 and the back material panel 18 is fixedly attached to the back rest portion 24 at the sides and to the box frame 68 back side 76 at the bottom.

While the disclosure is amenable to various modifications and alternative forms, specifics thereof have been shown by way of example in the drawings and described in detail. It is understood however, that the intention is not to limit the application to the particular embodiments described. On the contrary, the intention is to cover all modifications, equivalents, and alternative falling with the spirit and scope of the disclosure as defined by the appended claims.

Persons of ordinary skill in the relevant arts will recognize that various embodiments can comprise fewer features than illustrated in any individual embodiment described above. The embodiments described herein are not meant to be an exhaustive presentation of the ways in which the various features may be combined. Accordingly, the embodiments are not mutually exclusive combinations of features; rather, the claims can comprise a combination of different individual features selected from different individual embodiments, as understood by persons of ordinary skill in the art. Use of "end" and "edge" herein includes the end and edge regions proximate the geometric edge. In other words, for example, the end of a strap encompasses a few lengthwise inches at such end. Attachment at an edge can include an inch or two.

References to "embodiment(s)", "disclosure", "present disclosure", "embodiment(s) of the disclosure", "disclosed embodiments", and the like contained herein refer to the specification (text, including the claims, and figures) of this patent application that are not admitted prior art.

For purposes of interpreting the claims, it is expressly intended that the provisions of 35 U.S.C. 112(f) are not to be invoked unless the specific terms "means for" or "step for" are recited in the respective claim.

The invention claimed is:

1. An upholstered sofa comprising:

a frame having a rectangular seat base, an upright back rest portion integral with the seat base, wherein the seat base has a rectangular shape and forms a box frame having a left side, a right side, a front side, and a back side, wherein the back rest portion is affixed to the back side of the seat base so that the back rest portion is in an upright position, the back rest portion further having a front side, a back side, and a lower portion, and comprising a top rail; and an upholstery sack having a back, a left side, a right side, an integrated upholstery support assembly including a back support material portion and integrated webbing, the back support material portion comprising a first material panel, the back support material portion having a top end and a bottom end, the integrated webbing comprising a plurality of straps, the webbing sewn to the back support material portion at the top end;

wherein the upholstery sack is disposed on the frame with the webbing and attached back support material portion top end attached to the top rail, and wherein the end are attached to the lower back rest plurality of straps are attached to the back rest portion.

2. The upholstered sofa of claim 1, wherein the webbing comprising a plurality of straps extending between the top end and the bottom end of the back support material portion.

3. The upholstered sofa of claim 1, wherein the back support material portion further comprises a second material panel, the second material panel providing a liner for laying against the frame.

4. The upholstered sofa of claim 1, wherein the upholstery sack further comprises one or more integrated back rest cushion cases defined by the back support material portion.

5. The upholstered sofa of claim 4, wherein the upholstery sack comprises at least one zipper and wherein each of the integrated back rest cushion is accessible for cushion material by way of the at least one zipper and wherein each of the cushion cases are filled with cushion material.

6. The upholstered sofa of claim 1, wherein the webbing and the attached back support material portion bottom end are attached to a back side of a breast rail at the lower portion of the back rest portion.

7. The upholstered sofa of claim 1, wherein the back support material portion comprises a plurality of material panels, wherein each material panel is sewn on at least one edge to an edge of a different material panel.

8. A method of assembling an upholstered sofa comprising:

providing a sofa frame having a rectangular seat, an upright back rest portion integral with the seat base, and a right arm rest and a left arm rest integral with the seat base and back rest portion wherein the seat base and back rest are disposed between the right arm rest and the left arm rest, wherein the seat base has a rectangular shape and forms a box frame having a left side, a right side, a front side, and a back side, wherein the back rest portion is affixed to the back side of the seat base, the back rest portion further comprises a back side, a back side outwardly facing surface, a bottom side, a top rail, and a breast rail;

receiving an upholstery sack having a back material panel, a left side material panel, a right side material panel, and an integrated upholstery support assembly, wherein the upholstery support assembly is further comprised of a material portion having a top end and a bottom end and at least one support portion having a length, a first end, a middle portion, and a second end wherein the at least one support portion first end is fixedly attached to the material portion top end and the at least one support portion second end is fixedly attached to the material portion bottom end; and disposing the upholstery sack on the back rest portion and disposing the at least one support portion first end adjacent a top side of the top rail, fixedly attaching the at least one support portion first end and attached material portion top end to a back side of the top rail and disposing the at least one support portion middle portion adjacent a front side of the breast rail, and fixedly attaching the at least one support portion and material portion proximate the at least one support portion second end to a top side of the spring rail, fixedly attaching the left side material panel and right side material panel to the back rest portion, and fixedly attaching the back material panel to the back rest portion and seat base back side.

9. The method of claim 8, comprising fixedly attaching the at least one support portion and the material portion to the furniture frame with fasteners.

10. The method of claim 8, comprising fixedly attaching the at least one support portion and material portion proximate the at least one support portion second end to a back side of the breast rail.

11. A sofa comprising:

a wooden sofa frame, an upholstery sack comprising an exterior exposed upholstery material, an interior liner fabric, and a plurality of parallel straps, each of the parallel straps joined to the exterior exposed upholstery material, and the liner fabric at a sewn connection, and wherein the sack is stapled to the sofa frame, including each of the straps individually stapled to a frame member of the wooden sofa frame.

* * * * *